US011526120B2

(12) United States Patent
Hara

(10) Patent No.: US 11,526,120 B2
(45) Date of Patent: Dec. 13, 2022

(54) IMAGE FORMATION APPARATUS AND CONDUCTION UNIT

(71) Applicant: CANON KABUSHIKI KAISHA, Tokyo (JP)

(72) Inventor: Yoshiaki Hara, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/469,655

(22) Filed: Sep. 8, 2021

(65) Prior Publication Data

US 2022/0082993 A1 Mar. 17, 2022

(30) Foreign Application Priority Data

Sep. 14, 2020 (JP) ..... JP2020-153584

(51) Int. Cl.
*G03G 21/16* (2006.01)
*G03G 15/00* (2006.01)

(52) U.S. Cl.
CPC ..... *G03G 21/1652* (2013.01); *G03G 15/80* (2013.01); *G03G 21/1676* (2013.01)

(58) Field of Classification Search
CPC ..... G03G 15/80; G03G 21/1652; G03G 21/1676; G03G 21/1867; G03G 2221/163; G03G 2221/166; H01R 4/4863; H01R 4/64; H01R 13/2421
See application file for complete search history.

(56) References Cited

U.S. PATENT DOCUMENTS

2009/0214245 A1* 8/2009 Ito ..... G03G 15/80 399/88
2015/0037060 A1* 2/2015 Hamaya ..... G03G 15/80 29/857
2017/0248892 A1* 8/2017 Yamamoto
2019/0113883 A1* 4/2019 Hattori
2020/0064772 A1* 2/2020 Machii

FOREIGN PATENT DOCUMENTS

JP 2009109781 A 5/2009

* cited by examiner

*Primary Examiner* — Sophia S Chen
(74) *Attorney, Agent, or Firm* — Canon U.S.A., Inc. I.P. Division

(57) ABSTRACT

An image formation apparatus includes a development unit, a circuit board, a conduction member, a coil spring, and a holding member. The development unit develops an electrostatic image formed on a photoconductive drum. The circuit board supplies a voltage to the development unit. The conduction member electrically connects the development unit and the circuit board. The coil spring includes a coil part in contact with the conduction member and an arm part of the coil spring provided integrally with the coil part and extending from an end of the coil part outward in a radial direction with respect to the coil part. The holding member includes a spring regulation part to regulate movement of the coil spring in the radial direction. The holding member holds the coil spring in contact with the conduction member. The arm part includes a hook portion to engage with a portion of the holding member.

19 Claims, 11 Drawing Sheets

IMAGE FORMATION APPARATUS AND CONDUCTION UNIT

BACKGROUND

Field

The present disclosure relates to an image formation apparatus such as a printer, a copying machine, a facsimile machine, or a multi-function machine, and a conduction unit that is used for the image formation apparatus.

Description of the Related Art

Spring contacts such as coil springs are sometimes used to electrically connect units having a photoconductive drum, a development member, and the like of an image formation apparatus. Japanese Patent Application Laid-Open No. 2009-109781 discusses a structure in which process units such as a charging unit having a charging member and a development unit having a development member and a high-voltage circuit board supplying high voltage power are connected together by using spring contacts in which coil springs are integrally formed at both ends of a conductive wire material.

In the connection structure described in Japanese Patent Application Laid-Open No. 2009-109781, the wire material and the coil springs may be separately provided to allow the units and the high-voltage circuit board to be connected by a simple configuration. In this case, the electrical connection can be easily achieved by holding the coil springs in contact with the wire material.

However, in the structure where the contact members are separately provided as described above, if a coil spring is touched unintentionally during assembly or maintenance of the units, the coil spring may fall off, thereby degrading the workability of assembly and maintenance.

SUMMARY

An image formation apparatus disclosed herein works towards preventing the degradation of workability of assembly and maintenance, even in a case where coil springs are employed in electrical contact paths in an image formation apparatus.

According to an aspect of the present disclosure, an image formation apparatus includes a development unit configured to develop an electrostatic latent image formed on a photoconductive drum by using toner, a circuit board configured to supply a voltage to the development unit, a conduction member configured to electrically connect the development unit and the circuit board, a coil spring that includes a coil part in contact with the conduction member and an arm part of the coil spring provided integrally with the coil part and extending from an end of the coil part outward in a radial direction with respect to the coil part, and a holding member that includes a spring regulation part configured to regulate movement of the coil spring in the radial direction with respect to the coil part, wherein the holding member is configured to hold the coil spring such that the coil part and the conduction member are in contact with each other, and wherein the arm part of the coil spring includes a hook portion configured to engage with a portion of the holding member.

Further features of the present disclosure will become apparent from the following description of exemplary embodiments with reference to the attached drawings.

DESCRIPTION OF THE EMBODIMENTS

Hereinafter, preferred exemplary embodiments of the present disclosure will be described in detail with reference to the drawings. However, the dimensions, materials, shapes, and relative arrangements of components described in relation to the exemplary embodiments are not intended to limit the scope of the present disclosure thereto unless otherwise specified.

Figure 1:
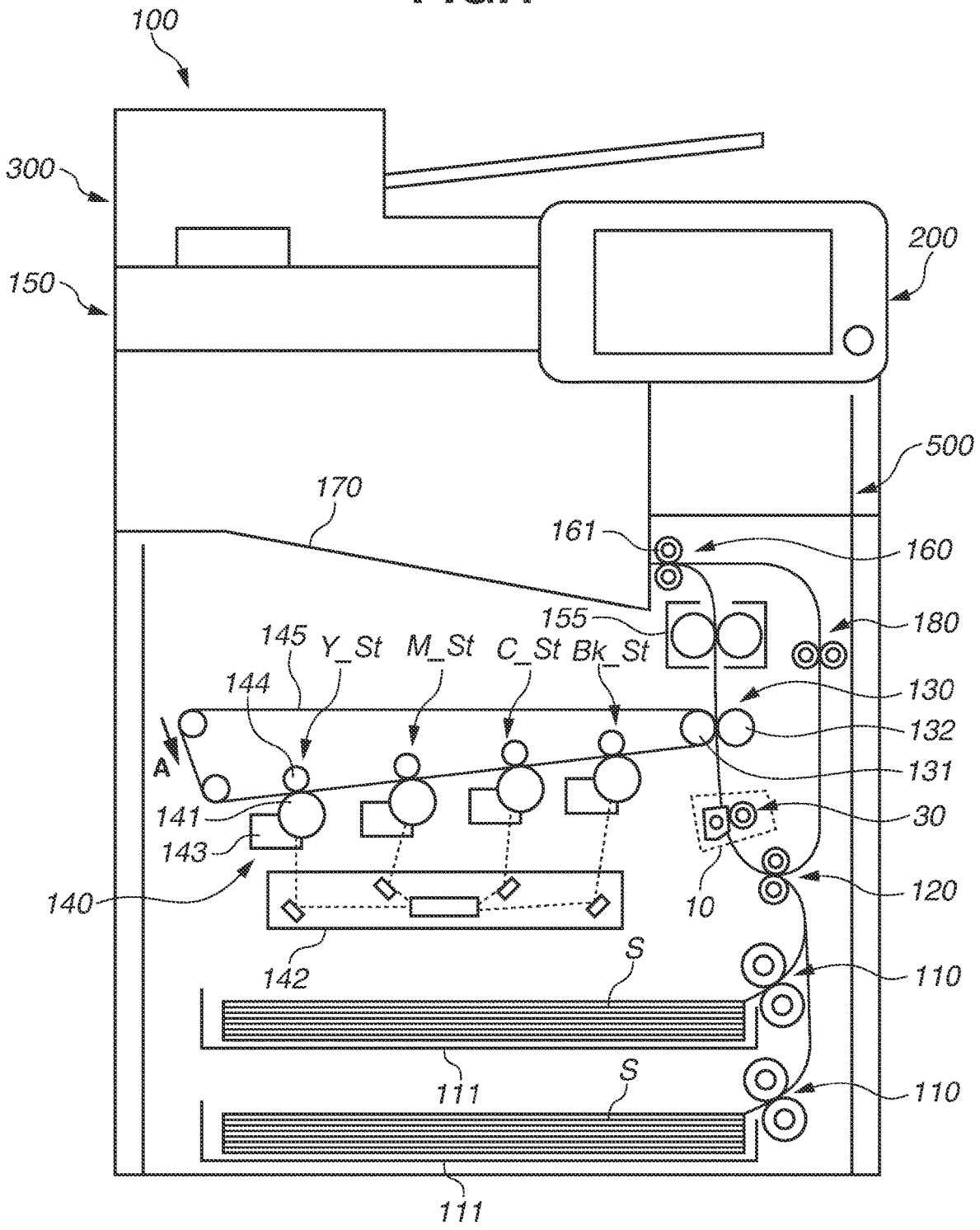
FIG. 1 is a schematic cross-sectional view of an image formation apparatus.

A first exemplary embodiment will be described. FIG. 1 is a schematic cross-sectional view of an image formation apparatus 100 in the present disclosure. An operation unit 200 with a user-operable touch panel is provided on the front side of the image formation apparatus 100. An image reading device 150 and a document conveyance device 300 are provided on the top of the image formation apparatus 100.

The image reading device 150 can read an image in a document placed on a reading glass plate (not illustrated) and can also read an image in a document that is conveyed by the document conveyance device 300 and is passed through a flow reading glass plate. The image data read by the image reading device 150 is processed as image information by a controller circuit board (not illustrated). At this time, the user can instruct the image reading device 150 via the operation unit 200 to execute reading.

Cassettes 111 can store paper sheets and overhead transparencies (OHTs) as sheets S on which an image is to be formed and can be drawn toward the front side of the image formation apparatus 100.

The controller circuit board described above generates a signal to emit laser light from a laser scanner unit 142, based on image information read by the image reading device 150 or image information input from an external device such as a personal computer (PC).

Then, electrostatic latent images are formed by the laser light emitted from the laser scanner unit 142 on photoconductive drums 141. The electrostatic latent images on the photosensitive drums 141 are developed by development sleeves that are development units provided in development devices 143, thereby to form toner images on the photosensitive drums 141.

An image formation unit 140 has four stations of Y St, M St, C St, and Bk St. The stations of the image formation unit 140 are the same in configuration, except that the colors of toners used are different, which are cyan, magenta, yellow, and black. Therefore, the configuration of the image formation unit Y St will be described below, and the detailed description of configurations of the image formation units M St, C St, and Bk St will be omitted.

The toner images formed on the photosensitive drum 141 are subjected to predetermined pressuring forces and electrostatic load biases by a primary transfer device 144, so that the toner images are transferred onto an intermediate transfer belt 145.

Next, the intermediate transfer belt 145 will be described. The intermediate transfer belt 145 is driven and conveyed in a direction of arrow A illustrated in FIG. 1. Therefore, the toner images are processed in parallel by the above-described Y, M, C, and Bk stations. The stations perform their respective image formation processes at timings that causes the respective toner images to be overlapped on the upstream toner image primarily transferred on the intermediate transfer belt 145. As a result, finally, a full-color image is formed on the intermediate transfer belt 145 and conveyed to a secondary transfer portion 130 in accordance with the rotation of the intermediate transfer belt 145.

In the meantime, the sheets S such as paper sheets or OHTs stacked and stored in the cassettes 111 are separated and fed one by one by sheet feeding units 110. The one fed sheet S is delivered to a first conveyance roller pair 120 and is conveyed toward a sheet skew correction device 10 arranged downstream in a sheet conveyance direction, so that the skew in the sheet S is corrected. Then, the sheet S is conveyed to the secondary transfer portion 130 by a second conveyance roller pair 30.

The sheet S conveyed to the secondary transfer portion 130 is nipped between a secondary transfer inner roller 131 and a secondary transfer outer roller 132 with the intermediate transfer belt 145 in between, so that the full-color toner image is secondarily transferred onto the sheet S by the secondary transfer portion 130.

Then, the sheet S is conveyed to a fixing device 155. The fixing device 155 melts and fixes the toner on the sheet S by applying a predetermined pressing force from a substantially opposing roller or belt and by bringing a heating effect of a heat source such as a heater, in general.

The sheet S with the thus obtained fixed image passes through a post-fixing conveyance unit 160 and is discharged by a discharge roller 161 directly to a sheet discharge tray 170. In order to form images on both sides of the sheet S, the discharge roller 161 is reversely rotated to convey the sheet S with the image on one side to a reverse conveyance device 180, and then the sheet S is conveyed again by the first conveyance roller pair 120 to the secondary transfer portion 130 where the image is formed on the other side of the sheet S.

The units described above are held in a frame body 500 described below.

Figure 2A:
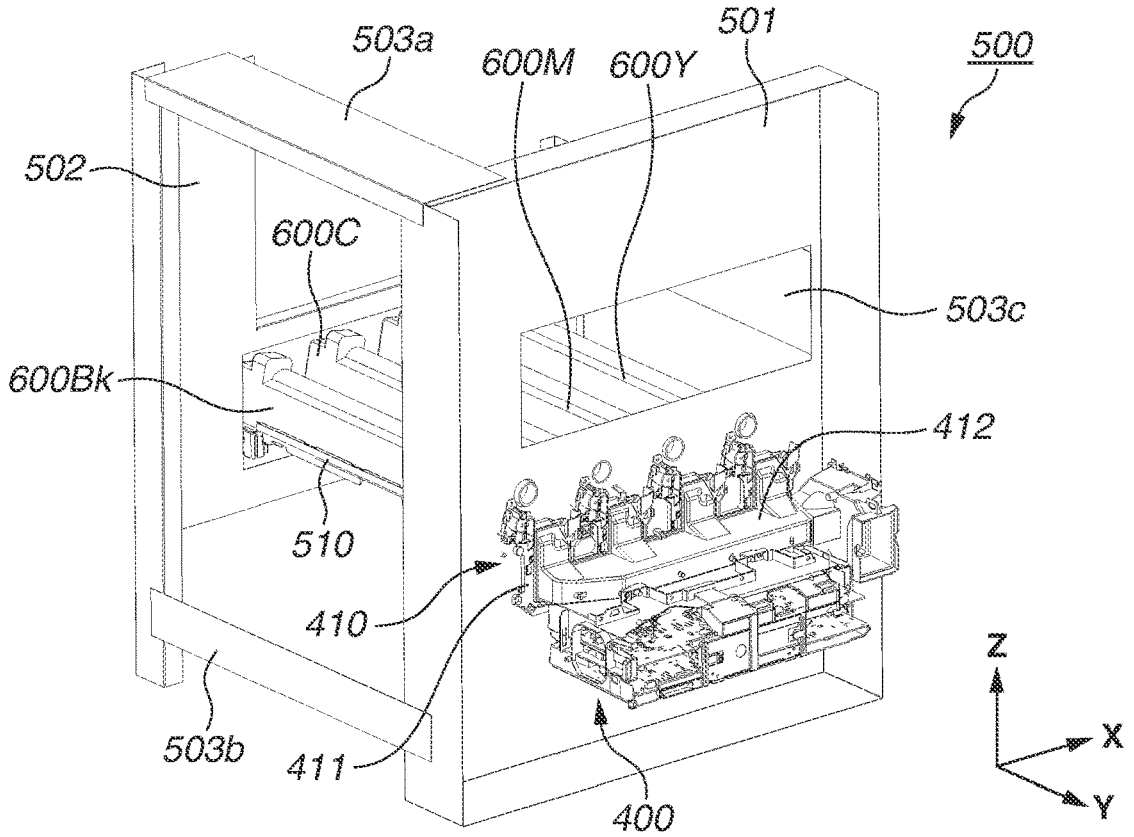
FIGS. 2A and 2B are perspective views of a rear side of the image formation apparatus.
Figure 2B:
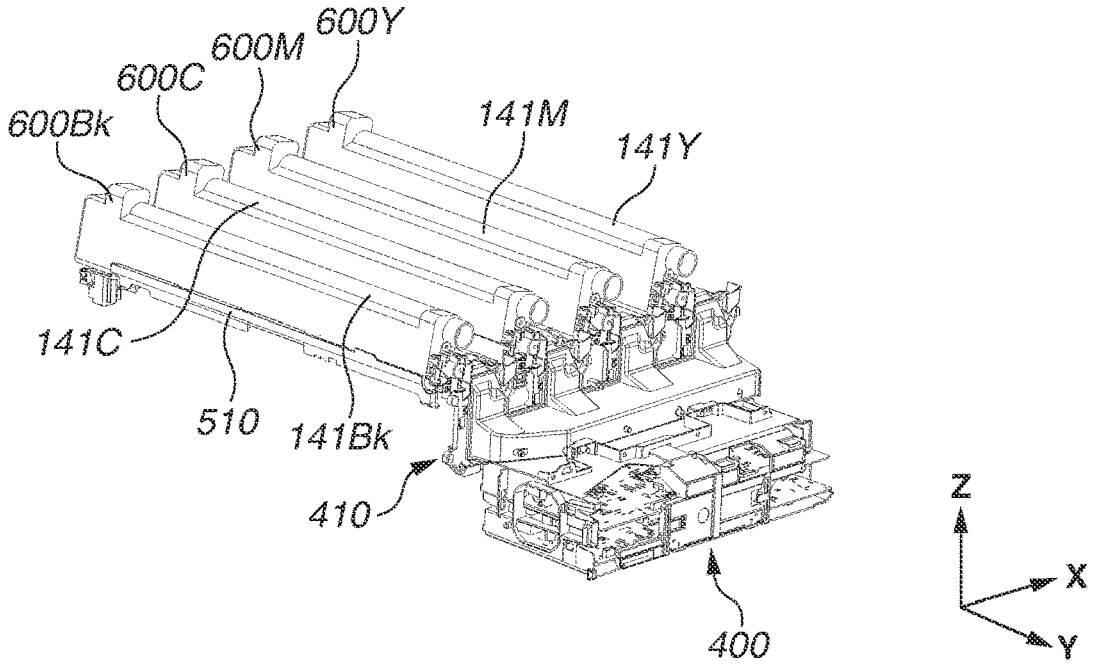

Next, high-voltage power supply paths to drum units 600 having the photosensitive drums 141 in the image formation apparatus 100 of the present disclosure will be described with reference to FIGS. 2 to 4. FIGS. 2A and 2B are perspective views of the image formation apparatus 100 without an exterior cover viewed from the rear side. FIG. 2A is a perspective view of the high-voltage power supply paths supported by the frame body 500, and FIG. 2B is a perspective view of the high-voltage power supply paths.

The frame body 500 has a back side plate 501 provided on the rear side of the image formation apparatus 100, a front side plate 502 that is on the front side of the image formation apparatus 100 and supports the units together with the back side plate 501, and stays 503*a* to 503*c* that couple the back side plate 501 and the front side plate 502.

A high-voltage power supply path unit 410 is fixed to the back side plate 501 of the frame body 500 and is covered with a rear cover (not illustrated) constituting the outer appearance of the image formation apparatus 100. The high-voltage power supply path unit 410 has a high-voltage path holding member 411 and a duct 412 for exhausting the air in the image formation apparatus 100 to the outside. A high-voltage circuit board unit 400 is fixed to the high-voltage power supply path unit 410. The high-voltage circuit board unit 400 is an example of a first unit.

An exhaust fan unit 450 includes a fan and a duct (not illustrated), which are connected to the duct 412 of the high-voltage power supply path unit 410, and is fixed to the back side plate 501.

The drum units 600 include the photosensitive drums 141 and are supported by drum rails 510 provided on the frame body 500. The drum units 600 are guided along the drum rails 510 in the direction of rotation axes of the photosensitive drums 141 and are detachably attached to the image formation apparatus 100.

Figure 3A:
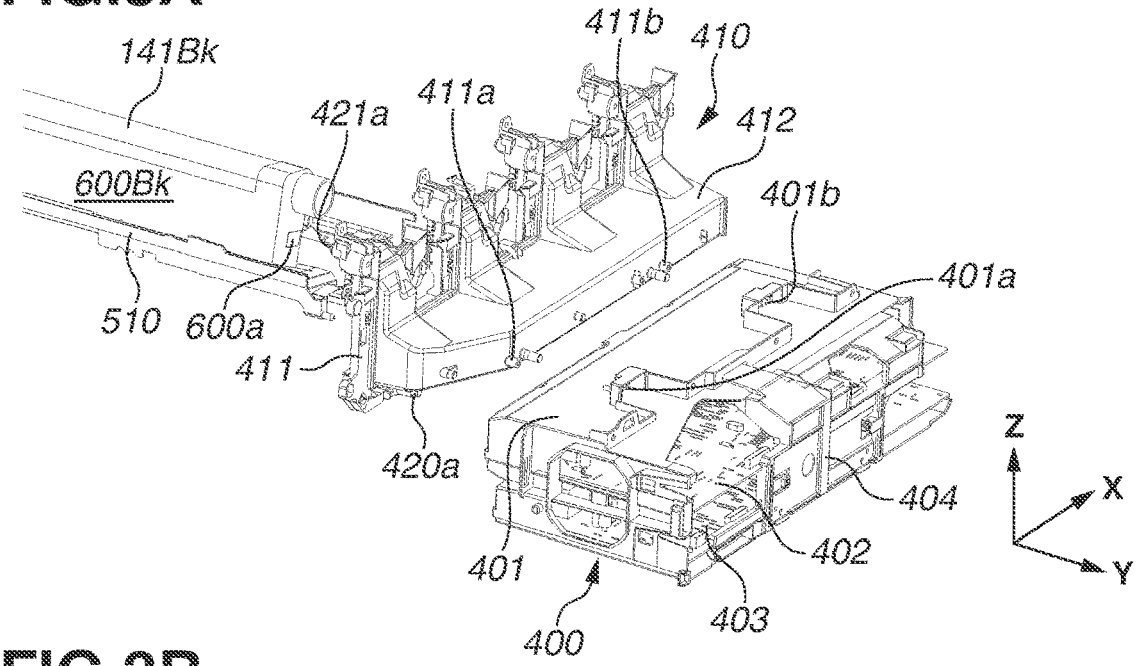
FIGS. 3A, 3B, and 3C are perspective schematic views of a high-voltage circuit board and its vicinity.
Figure 3B:
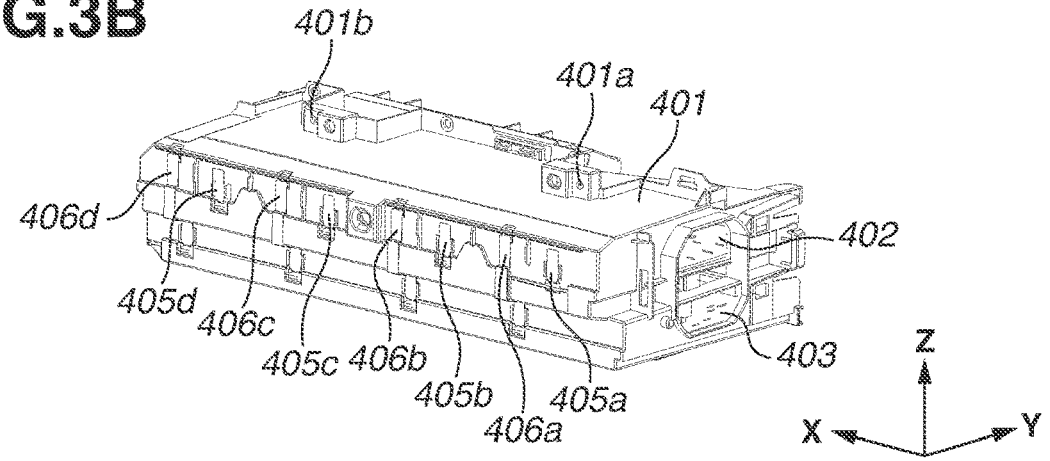
Figure 3C:
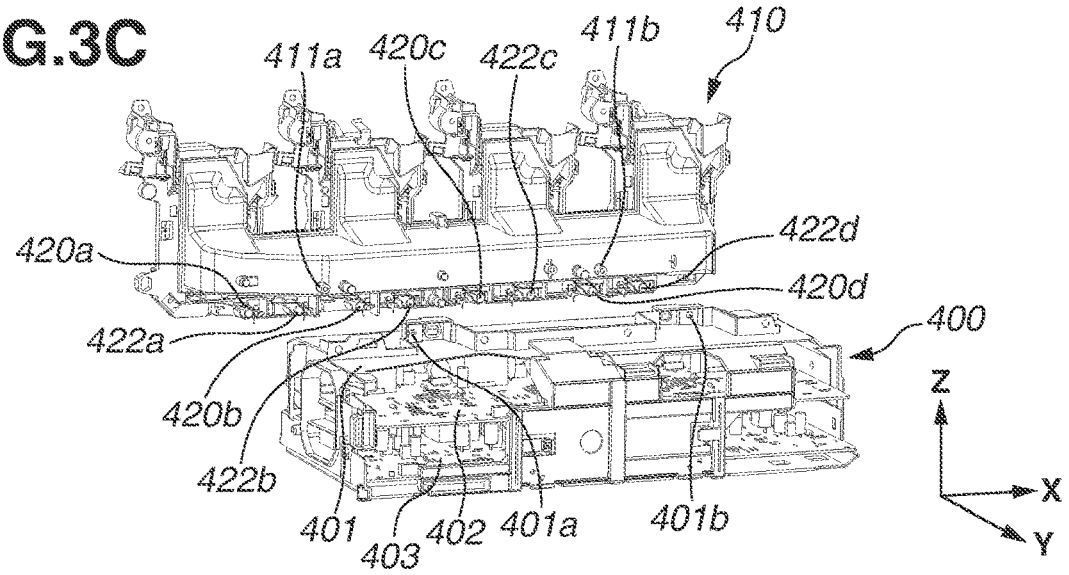

FIG. 3A is an exploded perspective view of one drum unit 600, the high-voltage circuit board unit 400, and the high-voltage power supply path unit 410. FIG. 3B is a perspective view of the high-voltage circuit board unit 400 viewed from the front side of the image formation apparatus 100. FIG. 3C is an exploded perspective view of the high-voltage circuit board unit 400 and the high-voltage power supply path unit 410. FIG. 3A illustrates only the drum unit 600Bk for black for the sake of convenience, but actually similar drum units Y, M, and C for yellow, magenta, and cyan are aligned in parallel in the direction of arrow X.

The high-voltage circuit board unit 400 has a casing 401 for holding the circuit boards, and a retainer 404 for preventing the circuit boards from falling off the casing 401. The casing 401 holds a charging high-voltage circuit board 402 which is a circuit board for high-voltage power supply to the drum units 600 and a development high-voltage circuit board 403 which is a circuit board for high-voltage power supply to the development devices 143 (FIG. 1) as the development units.

The high-voltage power supply path unit 410 includes compression springs 420*a* to 420*d* as contacts having conduction paths for power supply from the high-voltage circuit boards and connected to the charging high-voltage circuit board 402 for electric continuity, and compression springs 421*a* to 421*d* as contacts that are connected to the drum units 600Bk, 600C, 600M, and 600Y for electric continuity. The compression springs 420*a* to 420*d* and the compression springs 421*a* to 421*d* are capable of conduction by connection with solder-plated soft copper wires (hereinafter, called jumper wires). The structure of connection among the compression springs 420*a* to 420*d*, the compression springs 421*a* to 421*d*, and the jumper wires 413*a* to 413*d* will be described below in detail. In the present exemplary embodiment, the jumper wires 413*a* to 413*d* are an example of conduction members, and the compression springs 420*a* to 420*d* are an example of coil springs.

The high-voltage power supply path unit 410 includes compression springs 422*a* to 422*d* as contacts to be in electric continuity with the development high-voltage circuit board 403, and compression springs 423*a* to 423*d* as contacts to be in electric continuity with the development devices 143Bk, 143C, 143M, and 143Y. The compression springs 422*a* to 422*d* and the compression springs 423*a* to 423*d* are electrically connected (continuous) with each other, respectively, via the jumper wires 414*a* to 414*d*.

The high-voltage circuit board unit 400 also includes, as illustrated in FIGS. 3B and 3C, contact plate springs 405*a* to 405*d* that are in contact with the jumper wires 402*a* to 402*d* (FIG. 4) provided on the charging high-voltage circuit board 402 and are in contact with the compression springs 420*a* to 420*d* as contacts of the high-voltage power supply path unit 410, and contact plate springs 406*a* to 406*d* that are in contact with contacts (not illustrated) provided on the development high-voltage circuit board 403 and are in contact with compression springs 422*a* to 422*d* as contacts of the high-voltage power supply path unit 410.

The contact plate springs 405*a* to 405*d* are connected to the drum units 600Bk, 600C, 600M, and 600Y, respectively, via the high-voltage power supply path unit 410 and the contact plate springs 406*a* to 406*d* are connected to the paths to the development devices 143Bk, 143C, 143M, and 143Y, respectively, via the high-voltage power supply path unit 410.

In the present exemplary embodiment, the contact plate spring 405*a* is connected to the path to the drum unit 600Bk, the contact plate spring 405*b* is connected to the path to the drum unit 600C, the contact plate spring 405*c* is connected to the path to the drum unit 600M, and the contact plate spring 405*d* is connected to the path to the drum unit 600Y.

In the present exemplary embodiment, the contact plate spring 406*a* is connected to the path to the development device 143Bk, the contact plate spring 406*b* is connected to the path to the development device 143C, the contact plate spring 406*c* is connected to the path to the development device 143M, and the contact plate spring 406*d* is connected to the path to the development device 143Y.

The high-voltage circuit board unit 400 is fixed to the high-voltage power supply path unit 410 by fixing attachment surfaces 401*a* and 401*b* of the casing 401 via screws to tapped bosses 411*a* and 411*b* for screwing in the high-voltage power supply path unit 410. In this manner, when the high-voltage circuit board unit 400 is fixed to the high-voltage power supply path unit 410, the contact plate springs 405*a* to 405*d* and the contact plate springs 406*a* to 406*d* come into abutment with the compression springs 420*a* to 420*d* and the compression springs 422*a* to 422*d*, respectively, which leads to a connection state.

Next, the state of contact between the drum unit 600 and the high-voltage power supply path unit 410 will be described. The structures for contact between the drum units 600Bk, 600C, 600M, 600Y and the high-voltage power supply path unit 410 are the same. Hereinafter, the state of contact between the drum unit 600Bk for black and the high-voltage power supply path unit 410 will be described, and descriptions of contact states of the drum units 600C, 600M, and 600Y will be omitted.

The drum unit 600 is detachably attached to the image formation apparatus 100 by being guided on the drum rails 510 along the forward and backward direction (the Y direction in the drawing) of the image formation apparatus 100. In a state where the drum unit 600 is located at a position of attachment to the image formation apparatus 100, the contact 600*a* of the drum unit 600 and the compression spring 421*a*, which is a contact of the high-voltage power supply path unit 410, come into contact with each other. In this example, the position of attachment to the image formation apparatus 100 is a position where a coupling (not illustrated) in the drum unit 600 and a coupling (not illustrated) in the image formation apparatus 100 are coupled together. The photosensitive drum 141 of the drum unit 600 is rotated with a driving force from a driving unit (not illustrated) in the image formation apparatus 100 via the couplings at the position of attachment.

As above, in the state where the drum unit 600 is located at the position of attachment, the contact 600*a* and the compression spring 421*a* contact each other so that a charging roller (not illustrated) in the drum unit 600 is supplied with power to charge the photosensitive drum 141. The drum unit 600 is an example of a charging unit having a charging roller. In the present exemplary embodiment, the charging roller is supported by the drum unit 600. Alternatively, the photosensitive drum 141 and a unit supporting the charging roller may be separated.

Next, the high-voltage power supply path from the charging high-voltage circuit board 402 to the drum unit 600 will be described in detail. FIG. 4 is a perspective view of the power supply path from the charging high-voltage circuit board 402 to one drum unit 600. FIG. 4 illustrates only the drum unit 600Bk for black for the sake of convenience, but actually similar drum units 600Y, 600M, and 600C for yellow, magenta, and cyan are arranged in parallel. In addition, the development unit (the development device 143) is also not illustrated in the drawing, but actually there is a power supply path from the development high-voltage circuit board 403 like the power supply path to the drum unit 600. In this example, the drum unit 600 or the development unit (the development device 143) are an example of a second unit.

Figure 4:
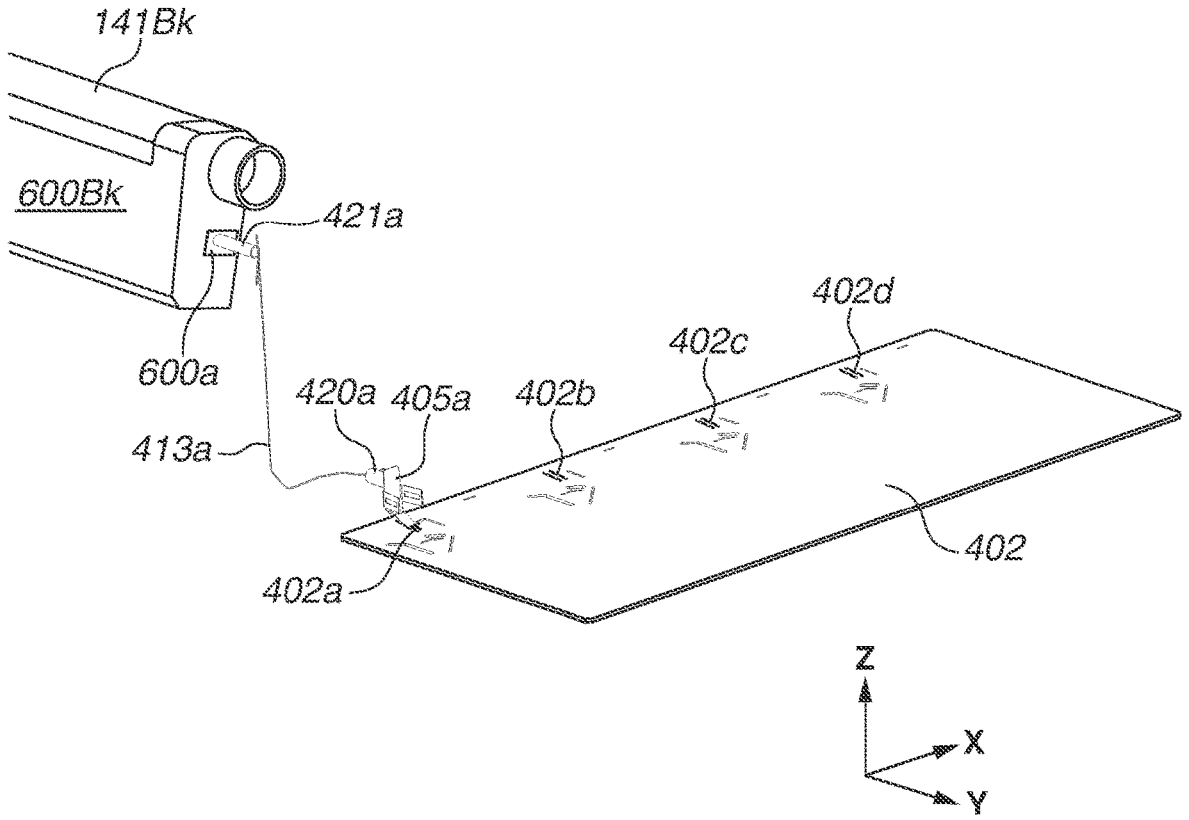
FIG. 4 is a perspective view of a power supply path from the high-voltage circuit board to a drum unit.

As shown in FIG. 4, the charging high-voltage circuit board 402 includes the jumper wires 402*a* to 402*d*. The jumper wire 402*a* is a contact on the charging high-voltage circuit board 402 in contact with the contact plate spring 405*a* for supplying power to the drum unit 600Bk. The jumper wire 402*b* is a contact on the charging high-voltage circuit board 402 in contact with the contact plate spring 405*b* for supplying power to the drum unit 600C. The jumper wire 402*c* is a contact on the charging high-voltage circuit board 402 in contact with the contact plate spring 405*c* for supplying power to the drum unit 600M. The jumper wire 402*d* is a contact on the charging high-voltage circuit board 402 in contact with the contact plate spring 405*d* for supplying power to the drum unit 600Y. The power supply paths between the drum units 600Bk, 600C, 600M, 600Y and the jumper wires 402*a* to 402*d* of the charging high-voltage circuit board 402 are substantially the same in configuration. Therefore, hereinafter, the high-voltage power supply path from the charging high-voltage circuit board 402 to the drum unit 600Bk will be described, and description of the high-voltage power supply paths between the other drum units 600C, 600M, 600Y and the development devices 143Bk, 143C, 143M, 143Y will be omitted.

The high-voltage generated by the charging high-voltage circuit board 402 is delivered to the jumper wire 402*a*, which is a contact provided on the circuit board. The jumper wire 402*a* is in contact with the contact plate spring 405*a* provided on the high-voltage circuit board unit 400.

The compression spring 420*a* provided on the high-voltage power supply path unit 410 is in contact with the contact plate spring 405*a*. The compression spring 420*a* is in contact with one end side of the jumper wire 413*a* held by the high-voltage path holding member 411. The other end side of the jumper wire 413*a* is contact with the compression spring 421*a*, which is a contact on the drum side, provided in the high-voltage power supply path unit 410.

The compression spring 421*a* provided on the high-voltage power supply path unit 410 and the contact 600*a* of the drum unit 600 come into contact with each other to supply high-voltage power from the charging high-voltage circuit board 402 to the drum unit 600.

As above, in the present exemplary embodiment, the boundaries between the units are the compression springs that provide a structure for contact using a biasing force. Accordingly, even in a case where the relative positions of the units are shifted due to tolerances or the like, it is possible to secure continuity in a stable manner.

Figure 5A:
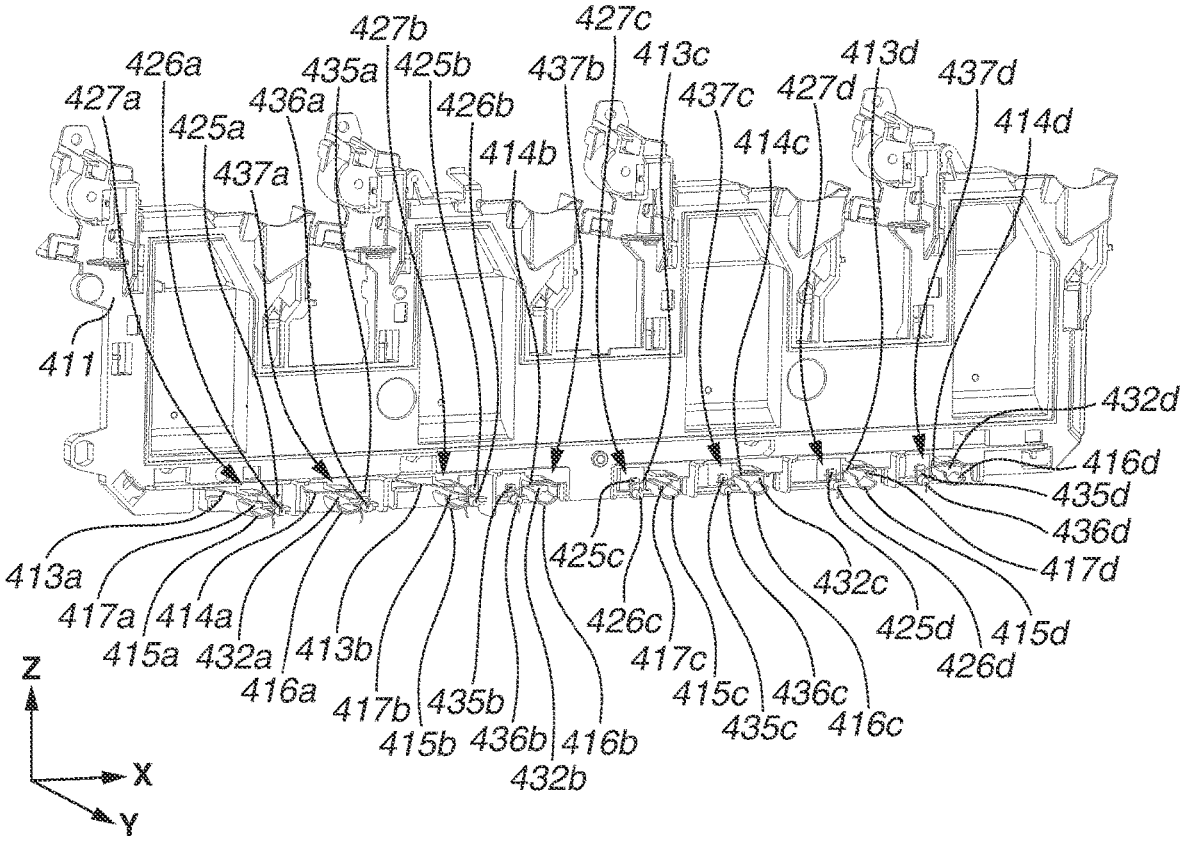
FIGS. 5A and 5B are schematic views of a high-voltage path holding member.
Figure 5B:
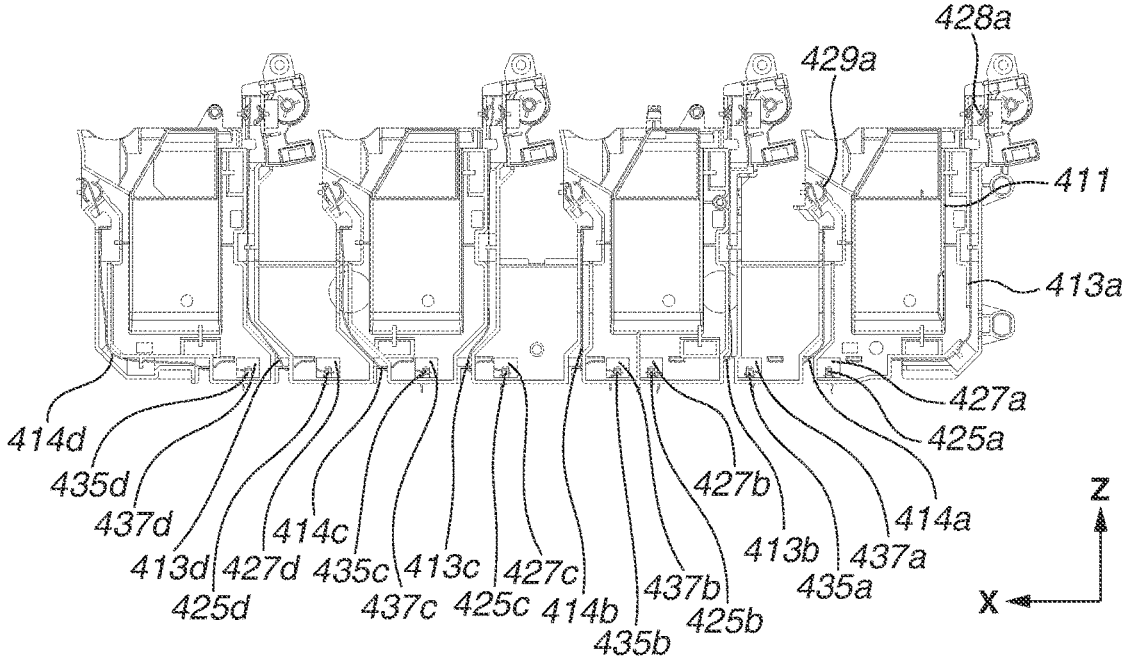

A high-voltage path configuration in the high-voltage power supply path unit 410 will now be described in detail. FIG. 5A is a diagram illustrating a state where the jumper wires are routed in the high-voltage path holding member 411 viewed from the high-voltage circuit board unit 400 side, and FIG. 5B is a diagram illustrating the same state viewed from the drum unit 600 side.

The high-voltage path holding member 411 includes cylindrical guides 415*a* to 415*d* that hold the compression springs 420*a* to 420*d* in contact with the contact plate springs 405*a* to 405*d* of the high-voltage circuit board unit 400, and cylindrical guides 416*a* to 416*d* that hold the compression springs 422*a* to 422*d* in contact with the contact plate springs 406*a* to 406*d*.

Provided near the cylindrical guides 415*a* to 415*d* are reception surfaces 417*a* to 417*d* where the compression springs 420 are seated, grapple parts 425*a* to 425*d* that grapple the jumper wires 413*a* to 413*d*, and bosses 426*a* to 426*d* around which the jumper wires 413*a* to 413*d* are wound. Opening portions 427*a* to 427*d* necessary for processing and forming the grapple parts 425*a* to 425*d* are provided adjacent to the cylindrical guides 415*a* to 415*d*. The cylindrical guides 415*a* to 415*d* are an example of spring regulation parts that regulate the movement of the compression springs 420*a* to 420*d* in a direction orthogonal to the axial direction (extension/contraction direction or free-length direction) of the compression springs 420*a* to 420*d*.

Provided near the cylindrical guides 416*a* to 416*d* are reception surfaces 432*a* to 432*d* where the compression springs 422 are seated, grapple parts 435*a* to 435*d* that grapple the jumper wires 414*a* to 414*d*, bosses 436*a* to 436*d* around which the jumper wires 414*a* to 414*d* are wound, and opening parts 437*a* to 437*d*.

The jumper wires 413*a* to 413*d* and the jumper wires 414*a* to 414*d* are held in different paths by the high-voltage path holding member 411, but are substantially the same in basic configuration. Thus, hereinafter, the jumper wires 413*a* and 414*a* will be described in detail as an example, and description of the other jumper wires 413*b* to 413*d* and 414*b* to 414*d* will be omitted. The cylindrical guides 415*a* to 415*d* and 416*a* to 416*d* are an example of spring regulation parts that regulate the movement of the compression springs 420*a* to 420*d* in the direction orthogonal to the axial direction (extension/contraction direction or free-length direction) of the compression springs 420*a* to 420*d* and 422*a* to 422*d*.

As illustrated in FIG. 5A, with an end part wound around the boss 426*a* and grappled with the grapple part 425*a*, the jumper wire 413*a* is wired through the cylindrical guide 415*a* to the surface of the high-voltage path holding member 411 facing the drum unit 600*a*. With an end part wound around the boss 436*a* and grappled with the grapple part 435*a*, the jumper wire 414*a* is wired through the cylindrical guide 416*a* to the surface of the high-voltage path holding member 411 facing the development device 143.

As illustrated in FIG. 5B, the jumper wire 413*a* is wired to come across a cylindrical part 428*a* along the rib shape of the high-voltage path holding member 411 on the surface of the high-voltage path holding member 411 facing the drum unit. The jumper wire 414*a* is wired to come across a cylindrical part 429*a* along the rib shape of the high-voltage path holding member 411 on the surface of the high-voltage path holding member 411 facing the drum unit.

Figure 6A:
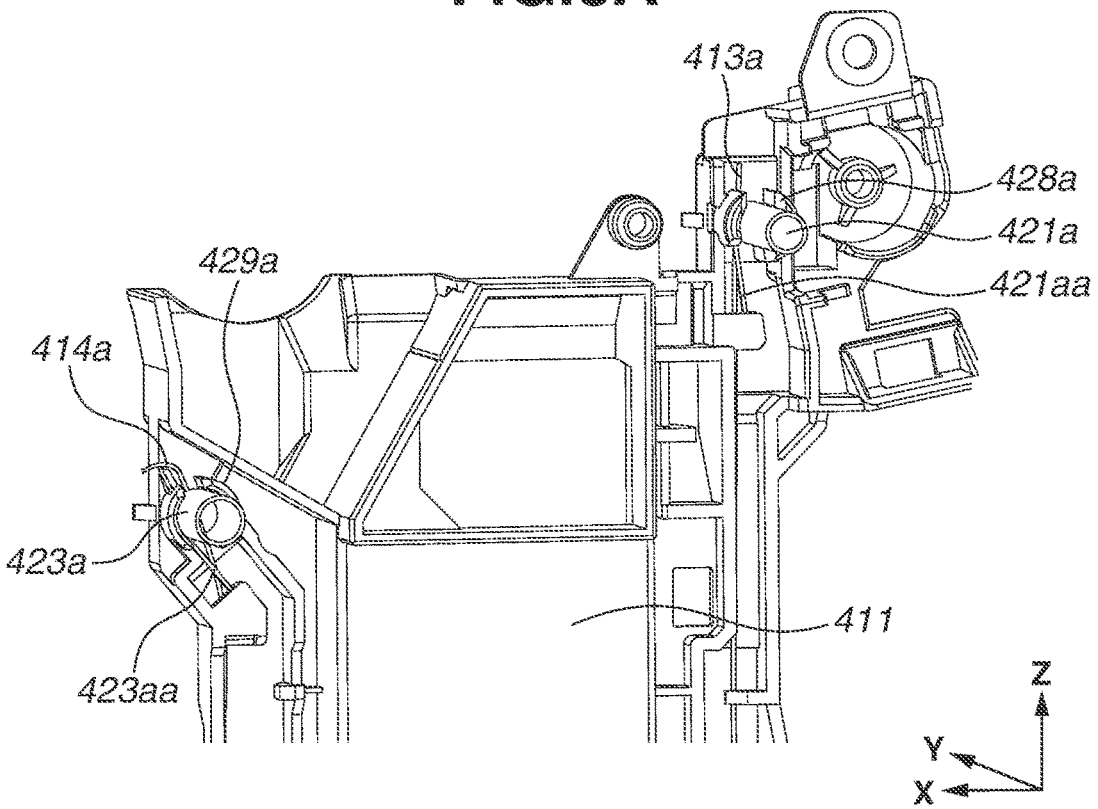
FIGS. 6A and 6B are schematic views of drum unit-side contacts of the high-voltage path holding member.
Figure 6B:
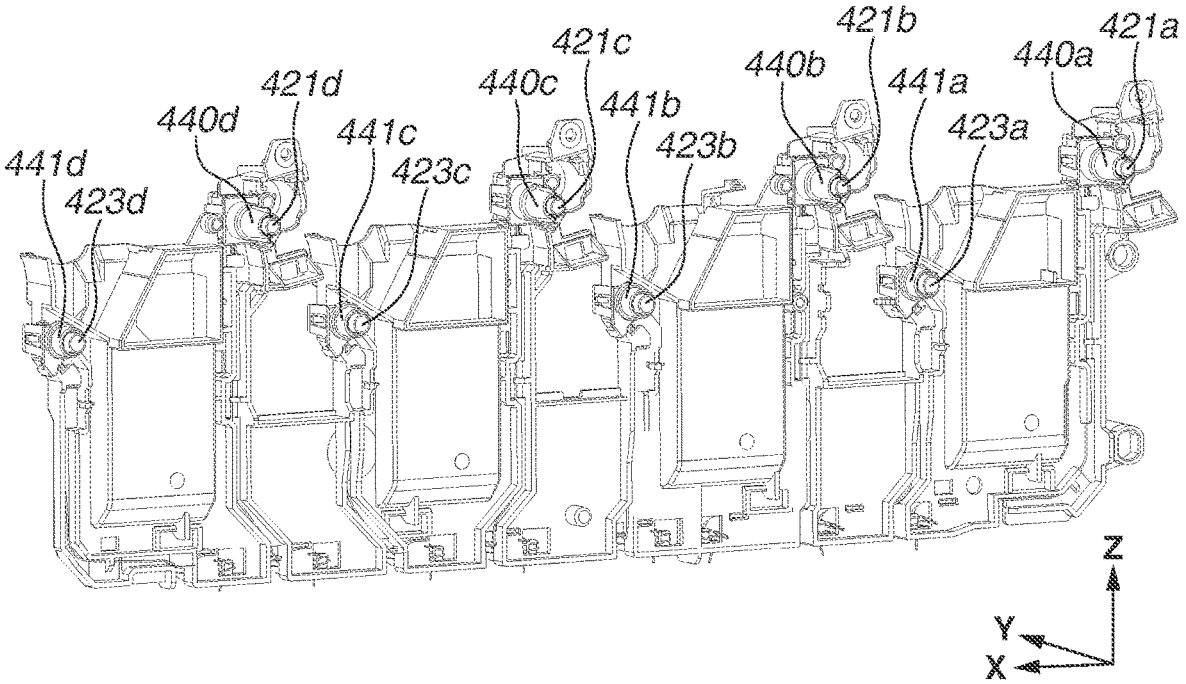

FIGS. 6A and 6B are diagrams illustrating a state where the compression springs 421*a* and 423*a* are attached to the high-voltage path holding member 411. FIG. 6A is an enlarged perspective view of the compression springs 421*a* and 423*a* and their neighborhoods, and FIG. 6B is a perspective view of the entire high-voltage path holding member 411.

As illustrated in FIG. 6A, the compression spring 421*a* is attached to the inside of the cylindrical part 428*a* so as to be in contact with the jumper wire 413*a* passing through the cylindrical part 428*a*. The compression spring 423*a* is attached to the inside of the cylindrical part 429*a* so as to be in contact with the jumper wire 414*a* passing through the cylindrical part 429*a*.

The compression spring 421*a* includes an arm part 421*aa* that protrudes radially outward from the cylindrical part of the spring. Similarly, the compression spring 423*a* includes an arm part 423*aa* that protrudes radially outward from the cylindrical part of the spring. Caps 440*a* to 440*d* and 441*a* to 441*d* are attached to the compression springs 421*a* to 421*d* and 423*a* to 423*d*, respectively, which are insulators to prevent leakage to the frame body 500 of the image formation apparatus 100. The cap 440*a* is attached to retain the arm part 421*aa* of the compression spring 421*a* illustrated in FIG. 6A, and the cap 441*a* is attached to retain the arm part 423*aa* of the compression spring 423*a* illustrated in FIG. 6A, thereby preventing the compression springs 421*a* and 423*a* from falling off the high-voltage path holding member 411. Similarly, the caps 440*b* to 440*d* and 441*b* to 441*d* are attached to retain the arm parts of the corresponding compression springs. The caps 440*a* and 441*a* have openings. Ends of the compression springs 421*a* and 423*a* opposite to the arm parts 421*aa* and 423*aa* seen in the extension/contraction direction (free-length direction) are exposed from the respective openings of the caps 440*a* and 441*a*, and are contactable with the contact 600*a* of the drum unit 600 or the contact of the development device 143.

Figure 7A:
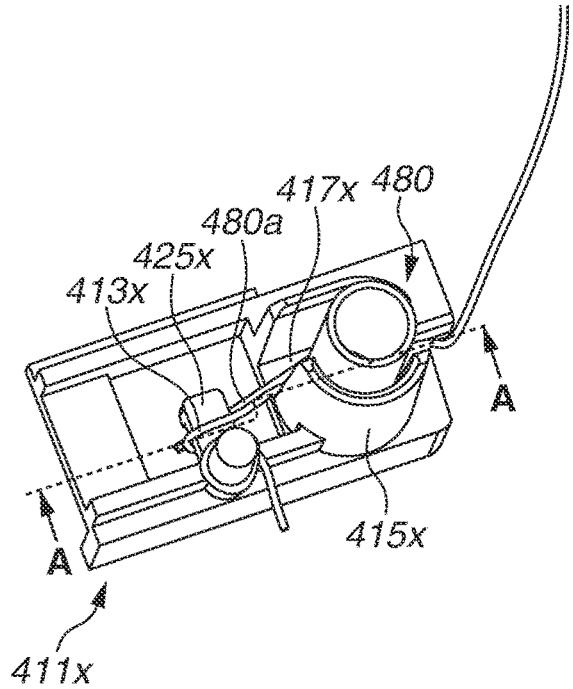
FIG.7A Prior Art
FIGS. 7A, 7B, and 7C are schematic views of a conventional structure for holding the compression spring.
Figure 7B:
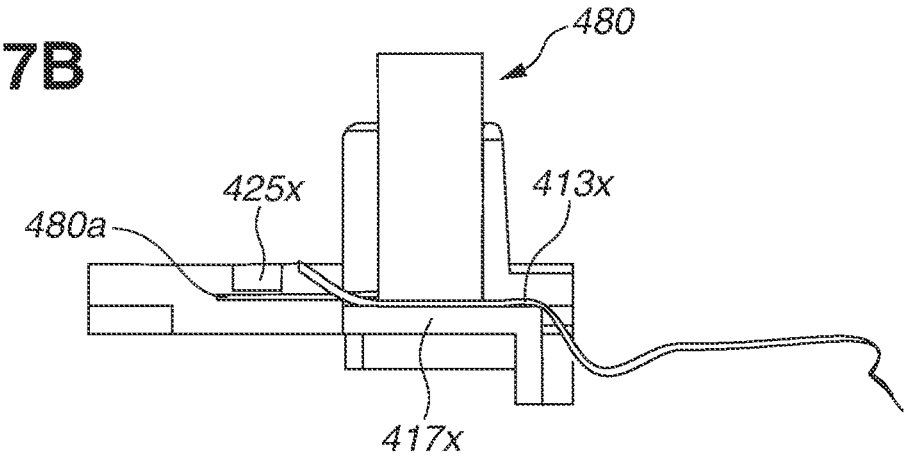
FIG.7B Prior Art
Figure 7C:
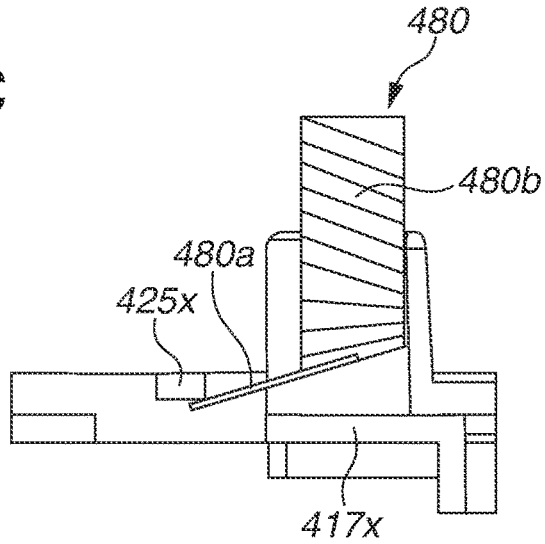
FIG.7C Prior Art

Next, a structure of the high-voltage path holding member 411 for holding the compression springs by the cylindrical guides 415 will be described. First, as a comparative example, a structure of a conventional high-voltage path holding member 411*x* for holding a compression spring 480 by a cylindrical guide 415*x* will be described. FIGS. 7A to 7C are diagrams illustrating the conventional structure for holding the compression spring 480, as the comparative example. FIG. 7A is a perspective view of the conventional structure for holding the compression spring 480, FIG. 7B is a cross-sectional view of FIG. 7A viewed from an A direction, and FIG. 7C is a diagram illustrating a state where the compression spring 480 is pulled in a direction away from a reception surface 417*x*. FIG. 7C does not illustrate a jumper wire 413*x* for the sake of convenience.

As illustrated in FIGS. 7A and 7B, the movement of the conventional compression spring 480 in the radial direction (parallel to the reception surface 417*x*) of the compression spring 480 is regulated by the cylindrical guide 415*x*, and the movement of the compression spring 480 in the vertical direction (the extension/contraction direction of the compression spring 480, the free-length direction of the compression spring 480) is regulated by an arm part 480*a*, which is provided to protrude radially outward from the cylindrical guide 415*x*, entering under the grapple part 425*x*. As above, conventionally, the arm part 480*a* of the compression spring 480 is grappled and held with the grapple part 425*x* so that the jumper wire 413*x* wired in the cylindrical guide 415*x* and the compression spring 480 are brought into contact with each other.

However, as illustrated in FIG. 7C, if the compression spring 480 is forced to be pulled in the vertical direction of the reception surface 417*x*, the winding wire of a spring cylindrical part 480*b* becomes elastically deformed as illustrated in FIG. 7C and the arm part 480*a* becomes slanted with respect to the grapple part 425*x*, so that the regulating force of the arm part 480*a* may decrease and cause the compression spring 480 to fall off. In addition, if the compression spring 480 is rotated, the arm part 480*a* and the grapple part 425*x* may become disengaged and cause the compression spring 480 to fall off the cylindrical guide 415*x*. As in the conventional example where the compression spring 480 and the jumper wire 413*x* are configured as separate members, if the compression spring 480 falls off the cylindrical guide 415*x*, the compression spring 480 and the jumper wire 413*x* become contactless so that electrical connection (continuity) between the two may no longer be secured.

If, while being hooked on the cylindrical guide 415*x* at a position as illustrated in FIG. 7C, the compression spring 480 contacts the contact 600*a* of the drum unit 600 or the contact of the development device 143 with respect to the high-voltage path holding member 411, the compression spring 480 possibly returns to the normal position illustrated in FIG. 7A. However, in a case where the winding wire of the spring cylindrical part 480*b* is caught on the cylindrical guide 415*x*, the compression spring 480 may not return to the normal position illustrated in FIG. 7A even in contact with the drum unit 600 or the development device 143, due to the biasing force of the spring cylindrical part 480*b*. In this case, the compression spring 480 and the jumper wire 413*x* become contactless (or are in an unstable contact with each other), so that continuity between the two may no longer be secured.

Thus, in the present exemplary embodiment, description will be provided as to a compression spring 420 which is capable of preventing a compression spring and a jumper wire from becoming contactless even if the compression spring and the jumper wire are configured as separate parts.

Figure 8A:
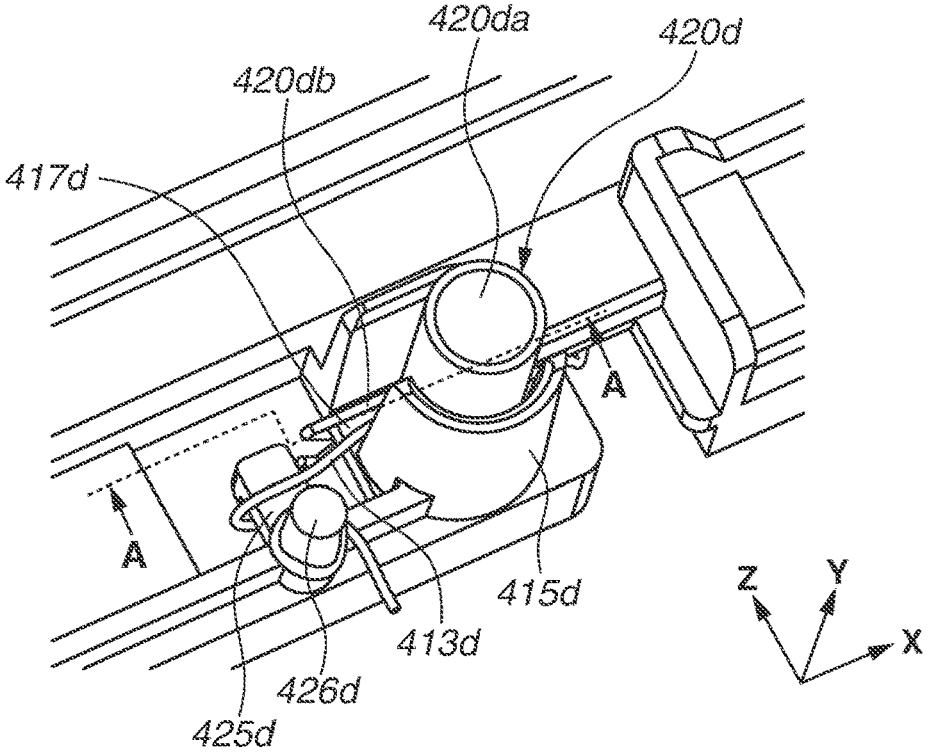
FIGS. 8A and 8B are schematic views of a compression spring and a high-voltage path holding member in a first exemplary embodiment.
Figure 8B:
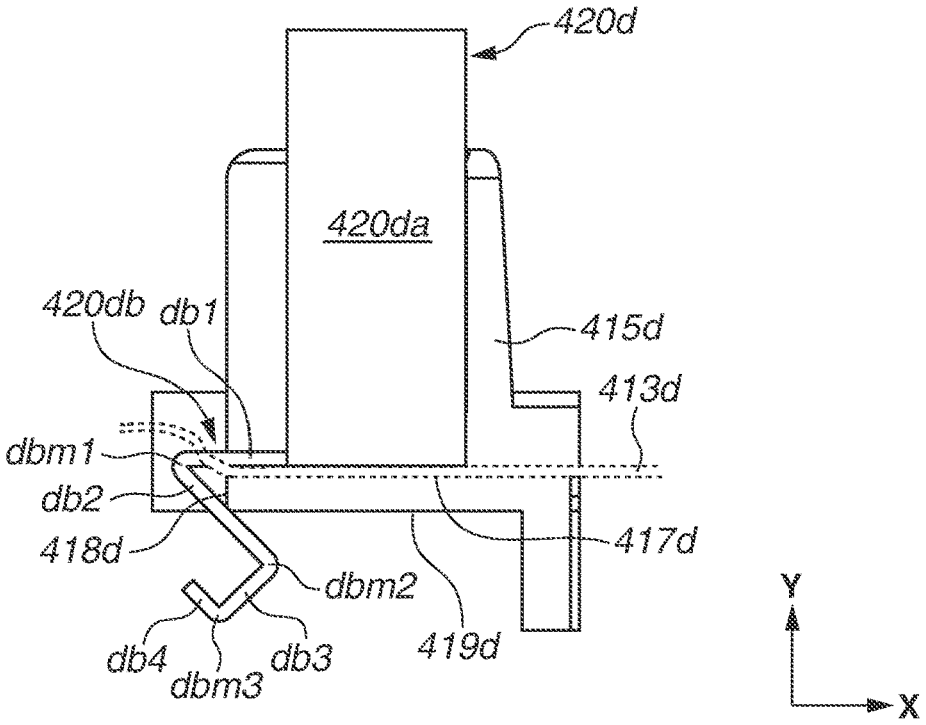

FIGS. 8A and 8B are diagrams illustrating a structure for holding the compression spring 420*d* according to the present exemplary embodiment. FIG. 8A is a perspective view of the compression spring 420*d* and its neighborhood, and FIG. 8B is a cross-sectional view of FIG. 8A viewed from an A direction.

In the description of the present exemplary embodiment, the compression spring 420*d* is taken as an example. However, the compression springs 420*a* to 420*c* and compression springs 422*a* to 422*d* described above are similar in shape to the compression spring 420*d*, and are engaged with the high-voltage path holding member 411 in similar configurations.

As illustrated in FIG. 8A, the jumper wire 413*d* is passed through the cylindrical guide 415*d*, and is grappled with the grapple part 425*d* and wound around the boss 426*d*. The compression spring 420*d* is attached to the inside of the cylindrical guide 415*d* so that the movement of the compression spring 420*d* in the planar direction of the reception surface 417*d* (the radial direction of the compression spring 420*d*) is regulated by the cylindrical guide 415*d*.

As illustrated in FIG. 8, the compression spring 420*d* according to the present exemplary embodiment has an arm part 420*db* that protrudes radially outward from a spring cylindrical part 420*da* wound in coil form. The compression spring 420*d* is formed from one wire, and the spring cylindrical part 420*da* and an arm part 420*db* are integrally provided. That is, the arm part 420*db* continuously extends from an end turn portion of the spring cylindrical part 420*da*. The arm part 420*db* has a first portion db1, a second portion db2, a third portion db3, a fourth portion db4, a first bend portion dbm1, a second bend portion dbm2, and a third bend portion dbm3. The jumper wire 413*d* is an example of a conduction member. The compression spring 420*d* is an example of a coil spring. The spring cylindrical part 420*da* is an example of a coil part.

The first portion db1 of the arm part 420*db* extends from one end of the spring cylindrical part 420*da* seen in the free-length direction. The second portion db2 of the arm part 420*db* is formed by bending the arm part 420*db* at the first bend portion dbm1 in a direction toward the spring cylindrical part 420*da* with respect to the first portion db1 such that the angle formed between the second portion db2 and the first portion db1 becomes an acute angle. The third portion db3 of the arm part 420*b* is formed by bending the arm part 420*db* at the second bend portion dbm2 in a direction away from the spring cylindrical part 420*da* with respect to the second portion db2 such that the angle formed between the third portion db3 and the second portion db2 becomes substantially a right angle. The fourth portion db4 of the arm part 420*db* is formed by bending the arm part 420*db* at the third bend portion dbm3 in a direction of arrow Y with respect to the third portion db3 such that the angle formed between the fourth portion db4 and the third portion db3 becomes substantially a right angle. Substantially a right angle in the present exemplary embodiment indicates not only 90° but also includes a range of tolerances at the time of manufacture of parts. In the present exemplary embodiment, substantially a right angle is defined an angle between 85° and 95°.

The arm part 420*db* thus configured nips the reception surface 417*d* between the first portion db1 and the second portion db2. This regulates the movement of the compression spring 420*d* in the direction of arrow Y (the free-length direction and extension/contraction direction of the compression spring 420*d*) with respect to the reception surface 417*d* of the compression spring 420*d*. Accordingly, even when the compression spring 420*d* is radially rotated with respect to the cylindrical guide 415*d* or is pulled in the direction of arrow Y, the compression spring 420*d* has the arm part 420*db* engaged with the reception surface 417 so that the compression spring 420*d* can be prevented from falling off the cylindrical part of the high-voltage path holding member 411.

Figure 9A:
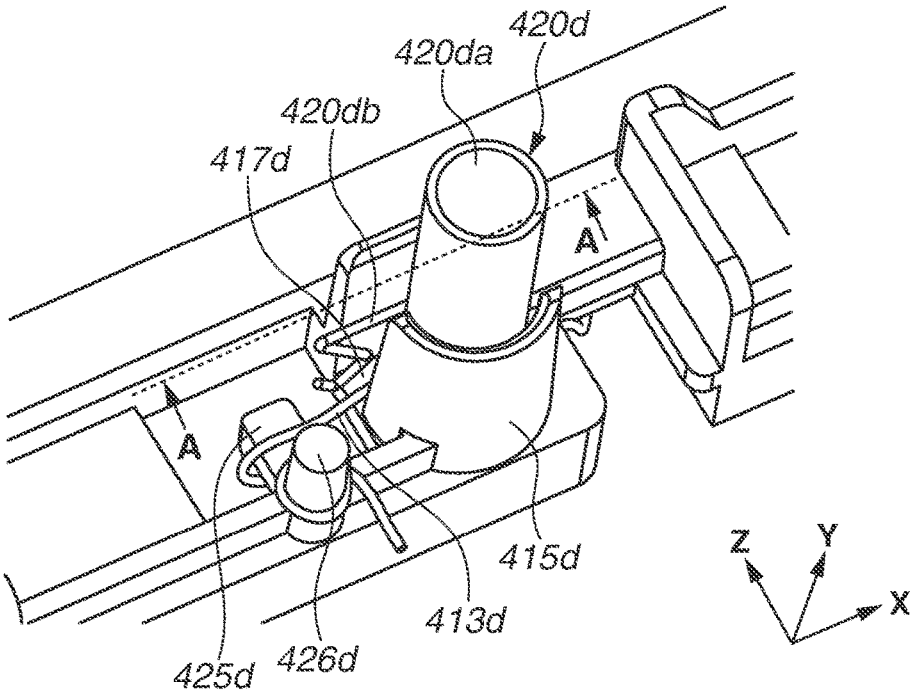
FIGS. 9A, 9B, and 9C are schematic diagrams illustrating states of the compression spring during assembly in the first exemplary embodiment.
Figure 9B:
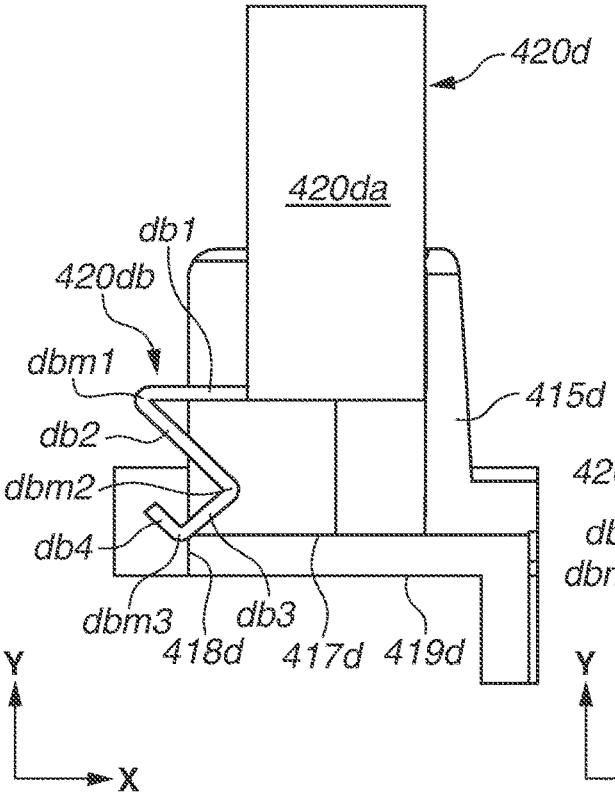
Figure 9C:
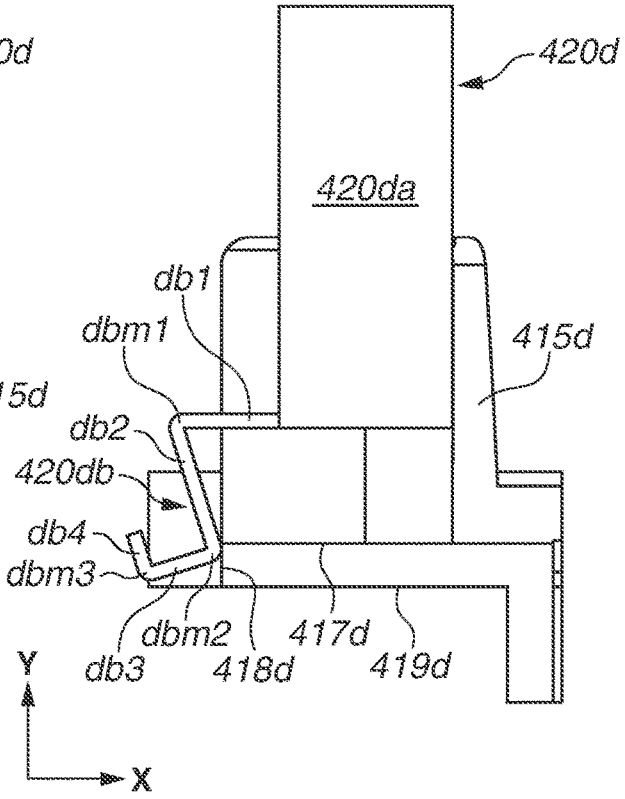

Next, a method of attaching the compression spring 420 to the high-voltage path holding member 411 according to the present exemplary embodiment will be described with reference to FIGS. 9A to 9C. FIG. 9A is a perspective view of the compression spring 420 and its neighborhood, FIG. 9B is a cross-sectional view of FIG. 9A taken along line A-A, and FIG. 9C is a diagram illustrating a state where the compression spring 420 is brought closer to the attachment position from the state of FIG. 9B. For the sake of convenience, FIGS. 9B and 9C do not illustrate the jumper wire 413*d*.

The compression spring 420*d* is aligned with the high-voltage path holding member 411 such that the spring cylindrical part 420*da* is fitted into the cylindrical guide 415*d* in which the jumper wire 413*d* is wired, and is pushed into the reception surface 417*d* in the direction opposite to the direction of arrow Y. The movement of the compression spring 420*d* in the direction parallel to the reception surface 417*d* is regulated by the cylindrical guide 415*d*.

As the compression spring 420*d* is further pushed in, the third portion db3 of the arm part 420*db* of the compression spring 420*d* abuts on an edge line between the reception surface 417*d* and an end face 418*d* of the reception surface 417*d*.

In this example, the presence of the third bend portion dbm3 between the third portion db3 and the fourth portion db4 of the arm part 420*db* prevents the leading edge of the arm part from directly striking and getting caught on the reception surface 417*d*, which would lead to a degradation in the workability of assembly.

When the compression spring 420*d* is further pushed into the reception surface 417*d* from the state illustrated in FIG. 9B, the second portion db2 of the arm part 420*db* opens due to elastic deformation such that the angle of the first bend portion dbm1 becomes larger with respect to the first portion db1, and the second bend portion dbm2 comes over the edge line between the reception surface 417*d* and the end face 418*d* of the reception surface 417*a* and moves along the end face 418*d* in the direction opposite to the direction of arrow Y (FIG. 9C).

Since the compression spring 420*d* has the second bend portion dbm2 provided to form the third portion db3 extending in a direction away from the axis of the compression spring 420*da*, the arm part 420*db* naturally widens along the slope of the third portion db3 when the spring is pushed in. This improves the workability of assembly at the time of attaching the compression spring 420*d* to the cylindrical guide 415*d* of the high-voltage path holding member 411.

As the compression spring 420*d* is continuously pushed in, the second bend portion dbm2 between the second portion db2 and the third portion db3 comes over the end face 418*d* and enters the state illustrated in FIG. 8B. When the second bend portion dbm2 comes over the end face 418*d*, the first bend portion dbm1 widened due to elastic deformation returns to the original angle, and the first portion db1 and the second portion db2 return to the original positional relationship, so that the second bend portion dbm2 is located over a back side 419*d* of the reception surface 417*d* at a position closer to the axis of the spring cylindrical part 420*da* than the end face 418*d* (FIG. 8B).

As described above, by causing the second portion db2 of the arm part 420*db* to get caught on the back side 419*d* and nipping the reception surface 417*d* between the first portion db1 and the second portion db2 of the arm part 420*db*, the movement of the compression spring 420*d* with respect to the reception surface 417*d* in the axial direction of the spring cylindrical part 420*da* of the compression spring 420*d* (the extension/contraction direction and free-length direction of the spring cylindrical part 420*da*) can be regulated.

According to the configuration described above, even in a case where the spring cylindrical part 420*da* of the compression spring 420*d* is pulled, the compression spring 420*d* can be prevented from falling off the high-voltage path holding member 411 as compared to the conventional example illustrated in FIG. 7, because the reception surface 417*d* is nipped between the first portion db1 and the second portion db2 of the arm part 420*db*, and the second bend portion dbm2 gets caught on the back side 419*d* of the reception surface 417*d* at a position closer to the axis of the spring cylindrical part 420*da* than the end face 418*d*. In the present exemplary embodiment, the first portion db1, the first bend portion dbm1, and the second portion db2 are an example of a hook portion that engages with a portion of the high-voltage path holding member 411.

In addition, in the state where the compression spring 420*d* is attached, the spring cylindrical part 420*da* of the compression spring 420*d* treads on the jumper wire 413*d* on the reception surface 417*d*, and the reception surface 417*d* is nipped by the arm part 420*db* to fix the compression spring 420*d*, and in the state where the high-voltage circuit board unit 400 is attached to the high-voltage path holding member 411, the compression spring 420*d* is biased to the jumper wire 413*d* to provide reliable contact between the compression spring 420*d* and the jumper wire 413*d* and secure continuity between the two.

The compression spring 420*d* has been described as an example of the present exemplary embodiment. However, the above-described compression springs 420*a* to 420*c* and compression springs 422*a* to 422*d* have similar shapes. Therefore, the above compression springs 420*a* to 420*c* and compression springs 422*a* to 422*d* can also be configured to be prevented from falling off the cylindrical guides 415*b* to 415*d* or 416*a* to 416*d* of the high-voltage path holding member 411 as described above.

As described above, configuring the jumper wires 413*a* to 413*d* and the compression springs 420*a* to 420*d* as separate parts improves the ease of assembling the contact members to the high-voltage path holding member 411. In addition, since the compression springs 420*a* to 420*d* are shaped as illustrated in FIGS. 8 and 9 described above, even when the compression spring 420*a* to 420*d* are touched unintentionally during assembly or maintenance of the units, the compression spring 420*a* to 420*d* can be prevented from falling off the cylindrical guides 415*a* to 415*d* of the high-voltage path holding member 411. This improves the workability during assembly or maintenance of the units.

In the first exemplary embodiment, the movement of the compression spring 420 in the direction parallel to the reception surface (the direction orthogonal to the extension/contraction direction of the compression spring and the radial direction of the compression spring) is regulated by supporting the spring outer diameter by the cylindrical guide 415. However, the compression spring may be supported by another structure. A second exemplary embodiment will be described.

Figure 10A:
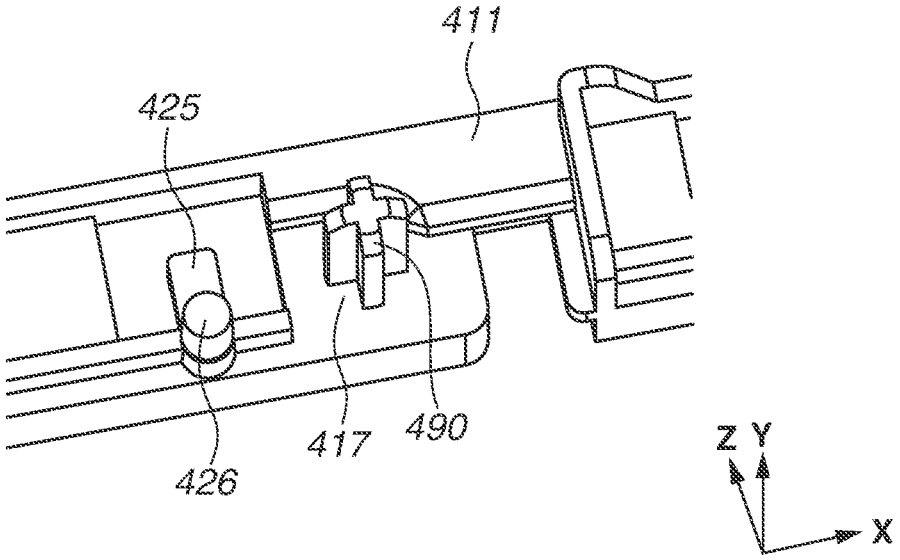
FIGS. 10A and 10B are schematic diagrams illustrating a structure for supporting a compression spring in a second exemplary embodiment.
Figure 10B:
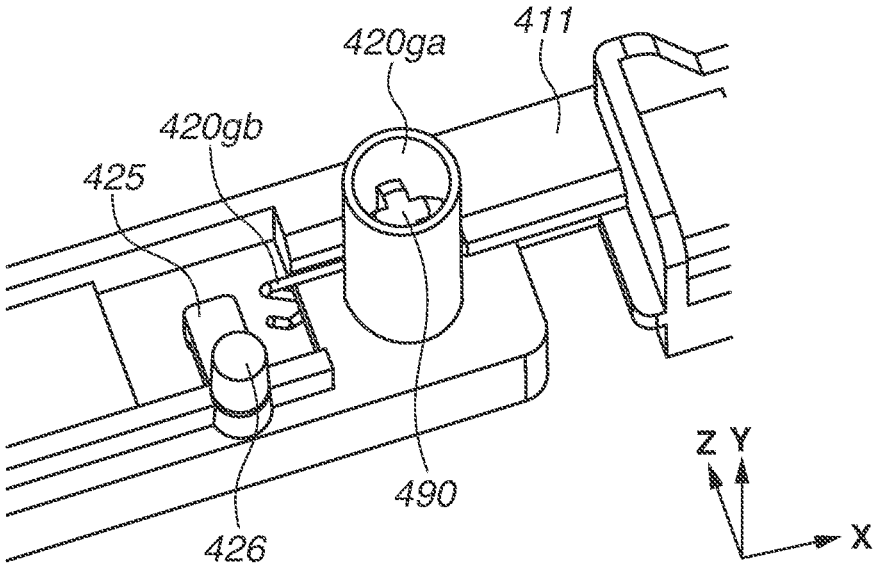

FIGS. 10A and 10B are perspective views of another structure for supporting a compression spring 420. FIG. 10A illustrates a state where the compression spring 420 is removed, and FIG. 10B illustrates a state where the compression spring 420 is attached.

As illustrated in FIGS. 10A and 10B, in the present exemplary embodiment, a reception surface 417 of a high-voltage path holding member 411 includes a cross-shaped boss 490. The compression spring 420 in the present exemplary embodiment is similar in configuration to the compression spring 420*d* described above with reference to FIG. 8. Hereinafter, as components of the compression spring 420, a spring cylindrical part will be denoted as 420*ga*, and an arm part extending outward in the radial direction of the spring cylindrical part 420*ga* will be denoted as 420*gb*.

Referring to FIG. 10, fitting the cylindrical part 420*ga* of the compression spring 420 to the boss 490 makes it possible to regulate the movement of the compression spring 420 in the direction orthogonal to the extension/contraction direction (free-length direction) of the compression spring 420. In addition, providing the arm part 420*gb* of the same shape as the arm part in the first exemplary embodiment makes it possible to regulate the movement of the compression spring 420 in the extension/contraction direction (free-length direction) of the compression spring 420. This prevents the compression spring 420 from falling off the high-voltage path holding member 411. Accordingly, it is possible to improve the workability during assembly and maintenance of the units.

In the first exemplary embodiment, the first bend portion dbm1 is formed such that the angle between the first portion db1 and the second portion db2 of the arm part 420*db* of the compression spring 420 becomes an acute angle. However, the first bend portion dbm1 may be formed in another shape.

Figure 11:
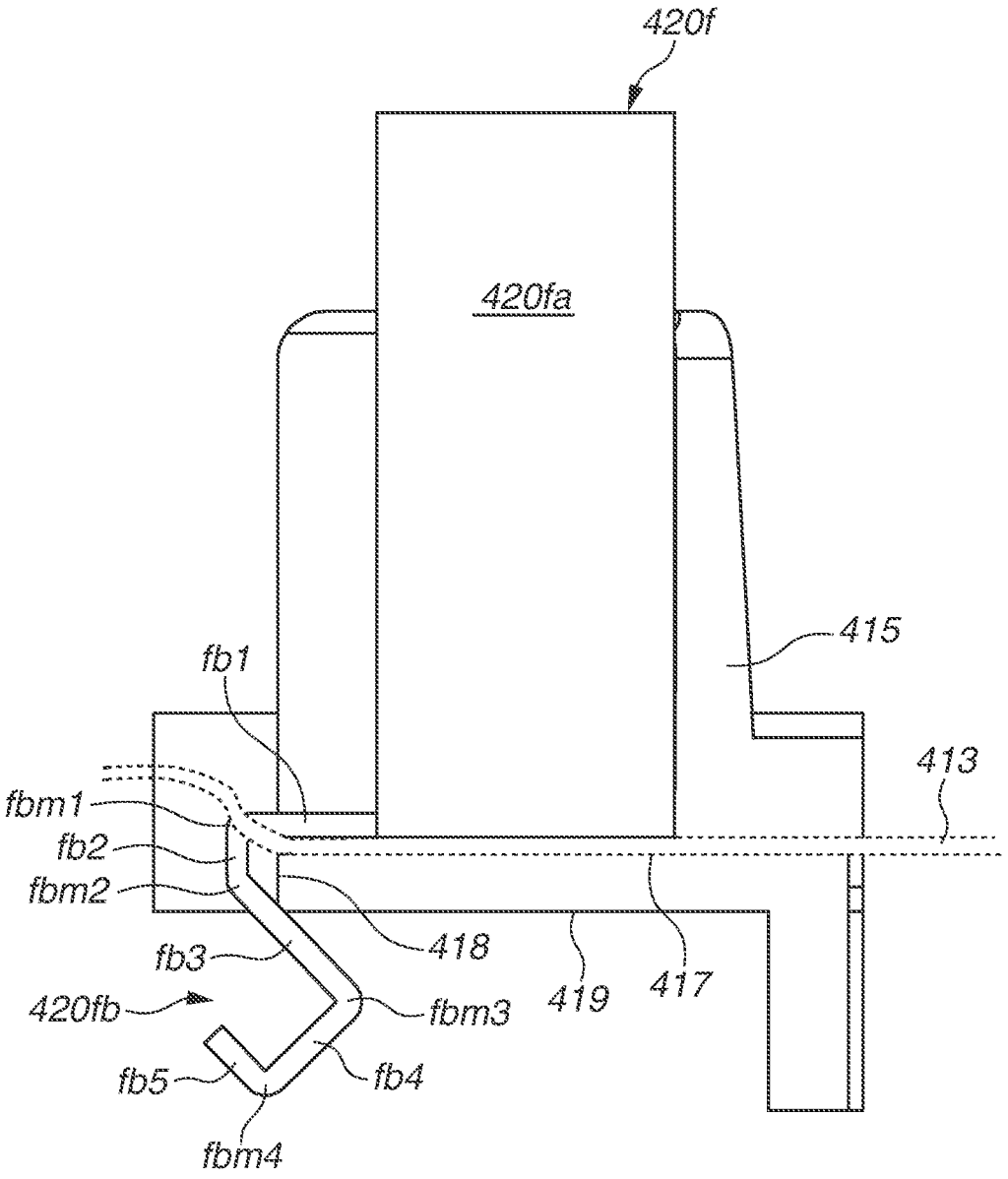
FIG. 11 is a schematic view of a compression spring in a third exemplary embodiment.

FIG. 11 is a cross-sectional view of a compression spring 420*f* in a third exemplary embodiment. The compression spring 420*f* illustrated in FIG. 11 has a spring cylindrical part 420*fa* and an arm part 420*fb* extending from the spring cylindrical part 420*fa*. The arm part 420*fb* in the present exemplary embodiment is different from the arm part 420*db* of the compression spring 420*d* in the first exemplary embodiment described above with reference to FIG. 8, in including one more bend portion than those of the arm part 420*fb* illustrated in FIG. 8.

As illustrated in FIG. 11, the arm part 420*fb* of the compression spring 420*f* in the present exemplary embodiment has a first portion fb1, a second portion fb2, a third portion fb3, a fourth portion fb4, a fifth portion fb5, a first bend portion fbm1, a second bend portion fbm2, a third bend portion fbm3, and a fourth bend portion fbm4.

The first portion fb1 of the arm part 420*fb* extends from one end of the spring cylindrical part 420*fa* in the free-length direction. The second portion fb2 of the arm part 420*fb* is formed by bending the arm part 420*fb* at the first bend portion fbm1 with respect to the first portion fb1 such that the angle formed between the second portion fb2 and the first portion fb1 becomes substantially a right angle. The third portion fb3 of the arm part 420*fb* is formed by bending the arm part 420*fb* at the second bend portion fbm2 in a direction toward the spring cylindrical part 420*fa* with respect to the second portion fb2 such that the angle formed between the third portion fb3 and the second portion fb2 becomes an obtuse angle. The fourth portion fb4 of the arm part 420*fb* is formed by bending the arm part 420*fb* at the third bend portion fbm2 in a direction away from the spring cylindrical part 420*fa* with respect to the third portion fb3 such that the angle formed between the fourth portion fb4 and the third portion fb3 becomes substantially a right angle. The fifth portion fb5 of the arm part 420*fb* is formed by bending the arm part 420*fb* at the fourth bend portion dbm4 in the direction of arrow Y with respect to the fourth portion fb4 such that the angle formed between the fifth portion fb5 and the fourth portion fb4 becomes substantially a right angle.

The thus configured arm part 420*fb* nips the reception surface 417 between the first portion fb1 and the third portion fb3. This regulates the movement of the compression spring 420*f* with respect to the reception surface 417 in a direction orthogonal to the horizontal direction (the free-length direction and extension/contraction direction of the compression spring 420*f*). Therefore, even in a case where the compression spring 420*f* is radially rotated with respect to the boss 490 or is pulled in the direction in which the compression spring 420*f* would fall off, the compression spring 420*f* can be prevented from falling off the high-voltage path holding member 411 because the reception surface 417 engages with the arm part 420*fb*. In the present exemplary embodiment, the first portion fb1, the first bend portion fbm1, the second portion fb2, the second bend portion fbm2, and the third portion fb3 are an example of a hook portion that engages with a portion of the high-voltage path holding member 411.

The arm part 420*db* in the first exemplary embodiment and the arm part 420*fb* in the second embodiment have angled hook portions. Alternatively, the hook portions may be arc-shaped as far as the hook portions engage with the back side 419*d* of the reception surface 417*d* of the high-voltage path holding member 411.

Other Exemplary Embodiments

In the exemplary embodiments described above, the compression springs 420 constitute the contacts between the high-voltage circuit board unit 400 and the high-voltage power supply path unit 410 as an example. Alternatively, the compression springs provided at other positions may have the same shape as in the exemplary embodiments described above. For example, the compression springs 421 or the compression springs 423 that constitute the contact points between the high-voltage power supply path unit 410 and the detachably attached units such as the drum unit 600 or the development devices 143 may include arm parts of a similar shape. All the compression springs may have the same shape as in the exemplary embodiments described above or only the compression springs 420 may have the same shape as in the exemplary embodiments described above. Alternatively, only the compression springs 421 may have the same shape as in the exemplary embodiments described above or only the compression springs 423 may have the same shape as in the exemplary embodiments described above. In the exemplary embodiments described above, the high-voltage power supply paths are taken as an example. However, the present disclosure is not limited to this, and the compression springs described above may be used as contacts for grounding.

In the exemplary embodiments described above, the compression springs 420 contact the jumper wires 413 as conduction members for continuity. However, another form of conduction members may be used as far as the conduction members provide continuity with the compression springs 420. For example, metal plates may be used as parts to be in contact with the compression springs 420 and jumper wires may be brought into contact with the metal plates to provide continuity. In this manner, the conduction members may be formed not only from the jumper wires 413 but also by a plurality of parts.

According to the present disclosure, even in a case where coil springs are employed in electrical contact paths, it is possible to improve the workability during assembly and service maintenance.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-153584, filed Sep. 14, 2020, which is hereby incorporated by reference herein in its entirety.

What is claimed is:

1. An image formation apparatus comprising:

a development unit configured to develop an electrostatic latent image formed on a photoconductive drum by using toner;

a circuit board configured to supply a voltage to the development unit;

a conduction member configured to electrically connect the development ui circuit board;

a coil spring that includes a coil part in contact with the conduction member and an arm part of the coil spring provided integrally with the coil part and extending from an end of the coil part outward in a radial direction with respect to the coil part; and a holding member that includes a spring regulation part configured to regulate movement of the coil spring in the radial direction with respect to the coil part, wherein the holding member is configured to hold the coil spring such that the coil part and the conduction member are in contact with each other, and wherein the arm part of the coil spring includes a hook poi configured to engage with a portion of the holding member.

2. The image formation apparatus according to claim 1, wherein the hook portion includes a first portion that extends outward in the radial direction with respect to the coil part and a second portion that is bent by a first bend portion with respect to the first portion, and wherein the portion of the holding member is positioned between the first portion and the second portion in an extension/contraction direction of the coil part.

3. The image formation apparatus according to claim 1, wherein the circuit board includes a contact portion electrically connected to the coil spring, and wherein, in the coil part, one end where the arm part of the coil spring is provided is in contact with the conduction member, and the end opposite to the one end is in contact with the contact portion, in an extension/contraction direction of the coil part.

4. The image formation apparatus according to claim 1, wherein the development unit has a contact portion electrically connected to the coil spring, and wherein, in the coil part, one end where the arm part of the coil spring is provided is in contact with the conduction member, and the end opposite to the one end is in contact with the contact portion, in an extension/contraction direction of the coil part.

5. The image formation apparatus according to claim 1, wherein the arm part of the coil spring further includes:

a first portion that extends outward in the radial direction with respect to the coil part, and a second portion that is bent by a first bend portion such that an angle formed between the second portion and the first, portion is an acute angle, wherein the second portion extends in such a manner that an end of the second portion opposite to the first bend portion comes closer to the coil part than the first bend portion, and wherein the end of the second portion opposite to the first bend portion is located on a back side opposite to a reception surface, and at a position closer to an axis of the coil part than the first bend portion.

6. The image formation apparatus according to claim 5, wherein the arm part of the coil spring further includes a third portion that extends from an end of the second portion opposite to the first portion, and wherein a second bend portion is provided between the second portion and the third portion, and wherein the second bend portion is bent such that the third portion extends in a direction away from an axis of a spring cylindrical part with respect to the second portion.

7. The image formation apparatus according to claim 1, wherein the conduction member is a solder-plated soft copper wire.

8. An image formation apparatus comprising:

a charging unit configured to charge an electrode latent image formed on a photoconductive drum;

a circuit board configured to supply a voltage to the charging unit;

a conduction member configured to electrically connect the charging unit and the circuit board;

a coil spring that includes a coil part in contact with the conduction member and an arm part of the coil spring provided integrally with the coil part and extending from an end of the coil part outward in a radial direction with respect to the coil part; and a holding member that includes a spring regulation part configured to regulate movement of the coil spring in the radial direction with respect to the coil part, wherein the holding member is configured to hold the coil spring such that the coil part and the conduction member are in contact with each other, and wherein the arm part of the coil spring includes a hook portion configured to engage with a portion of the holding member.

9. The image formation apparatus according to claim 8, wherein the hook portion includes a first portion that extends outward in the radial direction with respect to the coil part and a second portion that is bent by a first bend portion with respect to the first portion, and wherein the portion of the holding member is positioned between the first portion and the second portion in an extension/contraction direction of the coil part.

10. The image formation apparatus according to claim 8, wherein the circuit board includes a contact portion electrically connected to the coil spring, and wherein, in the coil part, one end where the arm part of the coil spring is provided is in contact with the conduction member, and the end opposite to the one end is in contact with the contact portion, in an extension/contraction direction of the coil part.

11. The image formation apparatus according to claim 8, wherein the charging unit has a contact portion electrically connected to the coil spring, and wherein, in the coil part, one end where the arm part of the coil spring is provided is in contact with the conduction member, and the end opposite to the one end is in contact with the contact portion, in an extension; contraction direction of the coil part.

12. The image formation apparatus according to claim 8, wherein the arm part of the coil spring includes:

a first portion that extends outward in the radial direction with respect to the coil part, and a second portion that is bent by a first bend portion such that an angle formed between the second portion and the first portion is an acute angle, wherein the second portion extends in such a manner that an end of the second portion opposite to the first bend portion comes closer to the coil part than the first bend portion, and wherein the end of the second portion opposite to the first bend portion is located on a back side opposite to a reception surface, and at a position closer to an axis of the coil part than the first bend portion.

13. The image formation apparatus according to claim 12, wherein the arm part of the coil spring further includes a third portion that extends from an end of the second portion opposite to the first portion, and wherein a second bend portion is provided between the second portion and the third portion, and wherein the second bend portion is bent such that the third portion extends in a direction away from an axis of a spring cylindrical part with respect to the second portion.

14. The image formation apparatus according to claim 8, wherein the conduction member is a solder-plated soft copper wire.

15. A conduction unit to be used in an image formation apparatus, wherein the image formation apparatus includes a development unit configured to develop an electrostatic latent image formed on a photoconductive drum by using toner, and includes a charging unit, wherein the charging unit is configured to charge the photoconductive drum, and is configured to (i) electrically connect the development unit and a circuit board configured to supply a voltage to the development unit or (ii) electrically connect the charging unit and a circuit board configured to supply a voltage to the charging unit, the conduction unit comprising:

a conduction member:

a coil spring that includes a coil part in contact with the conduction member and an arm part of provided integrally with the coil part and extending from an end of the coil part outward in a radial direction with respect to the coil part; and a holding member that includes a spring regulation part configured to regulate movement of the coil spring in the radial direction with respect to the coil part, wherein the holding member is configured to hold the coil spring such that the coil part and the conduction member are in contact with each other, wherein the coil part protrudes from the holding member in an extension/contraction direction of the coil part, and wherein the arm part of the coil spring includes a hook portion configured to engage with a portion of the holding member so as to regulate movement of the coil part in a direction away from the conduction member.

16. The image formation apparatus according to claim 15, wherein the hook portion includes a first portion that extends outward in the radial direction with respect to the coil part and a second portion that is bent by a first bend portion with respect to the first portion, and wherein the portion of the holding member is positioned between the first portion and the second portion in the extension/contraction direction of the coil part.

17. The image formation apparatus according to claim 15, wherein the arm part of the coil spring includes:

a first portion that extends outward in the radial direction with respect to the coil part, and a second portion that is bent by a first bend portion such that an angle formed between the second portion and the first portion is an acute angle, wherein the second portion extends in such a manner that an end of the second portion opposite to the first bend portion comes closer to the coil part than the first bend portion, and wherein the end of the second portion opposite to the first bend portion is located on a back side opposite to a reception surface, and at, a position closer to an axis of the coil part than the first bend portion.

18. The image formation apparatus according to claim 17, wherein the arm part of the coil spring further includes a third portion that extends from an end of the second portion opposite to the first portion, and wherein a second bend portion is provided between the second portion and the third portion, and wherein the second bend portion is bent such that the third portion extends in a direction away from an axis of a spring cylindrical part with respect to the second portion.

19. The image formation apparatus according to claim 15, herein the conduction member is a solder-plated soft copper wire.

* * * * *